US008141987B2

(12) United States Patent
Hayakawa et al.

(10) Patent No.: US 8,141,987 B2
(45) Date of Patent: Mar. 27, 2012

(54) INK JET RECORDING HEAD, MANUFACTURING METHOD THEREOF, AND ELECTRON DEVICE

(75) Inventors: Kazuhiro Hayakawa, Kawasaki (JP); Masaya Uyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 446 days.

(21) Appl. No.: 12/407,459

(22) Filed: Mar. 19, 2009

(65) Prior Publication Data

US 2009/0244198 A1 Oct. 1, 2009

(30) Foreign Application Priority Data

Mar. 26, 2008 (JP) ..... 2008-080747

(51) Int. Cl.
*B41J 2/05* (2006.01)

(52) U.S. Cl. ..... 347/64; 347/45; 347/65

(58) Field of Classification Search ..... 347/20, 347/44, 45, 47, 56, 61–65, 67
See application file for complete search history.

(56) References Cited

U.S. PATENT DOCUMENTS

| | | | | |
|---|---|---|---|---|
| 7,063,799 | B2 | 6/2006 | Hayakawa et al. | |
| 7,178,905 | B2 * | 2/2007 | Shin et al. | 347/65 |
| 7,323,115 | B2 | 1/2008 | Hayakawa et al. | |
| 7,452,474 | B2 | 11/2008 | Komuro et al. | |
| 7,517,059 | B2 | 4/2009 | Hayakawa | |
| 7,585,053 | B2 * | 9/2009 | Kim et al. | 347/56 |
| 7,607,759 | B2 * | 10/2009 | Min et al. | 347/63 |

FOREIGN PATENT DOCUMENTS

JP 9-11478 * 1/1997

* cited by examiner

*Primary Examiner* — Juanita D Jackson
(74) *Attorney, Agent, or Firm* — Fitzpatrick, Cella, Harper & Scinto

(57) ABSTRACT

An ink jet recording head includes a substrate, having a front surface and a back surface opposite from the front surface, provided above the front surface with an energy generating element for generating energy used for ejecting ink; an ink supply port provided so as to penetrate between the front surface and the back surface of the substrate; a first layer provided on or above the front surface of the substrate; a protection layer which is provided so as to coat a wall of the substrate defining the ink supply port and which continuously extends onto the first layer; and a second layer located above the front surface of the substrate and including a portion provided on the protection layer and another portion provided on the first layer by penetrating through the protection layer.

4 Claims, 11 Drawing Sheets

Fig. 4(a)
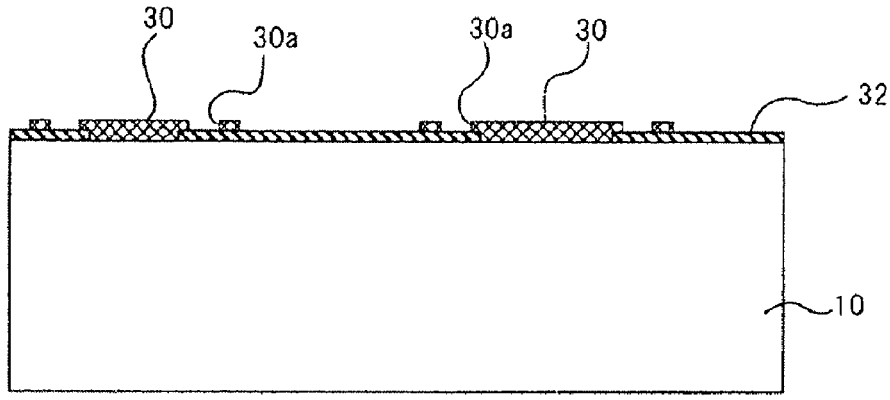
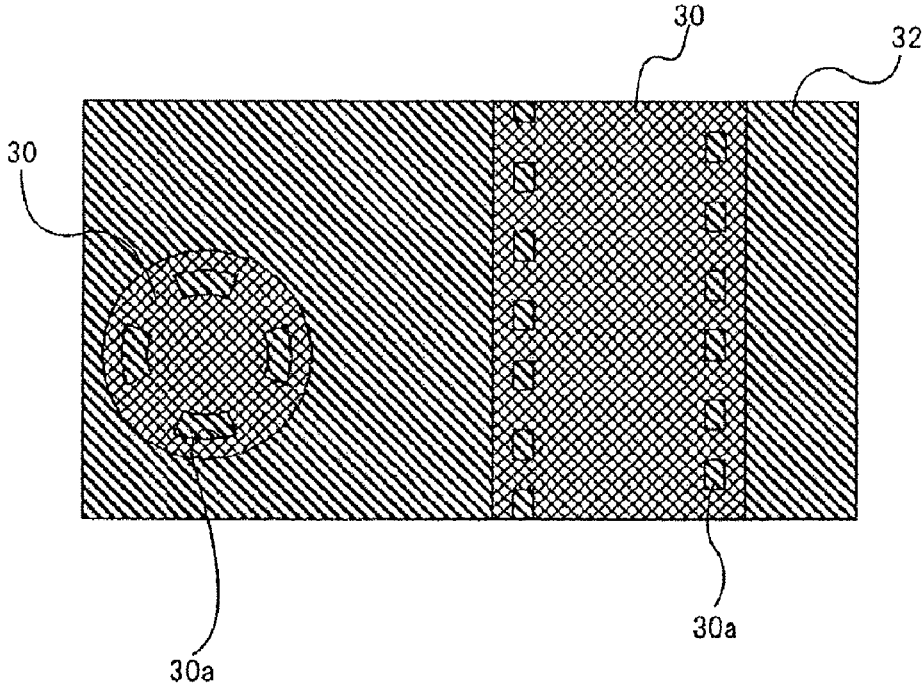
Fig. 4(b)

Fig. 7(a)
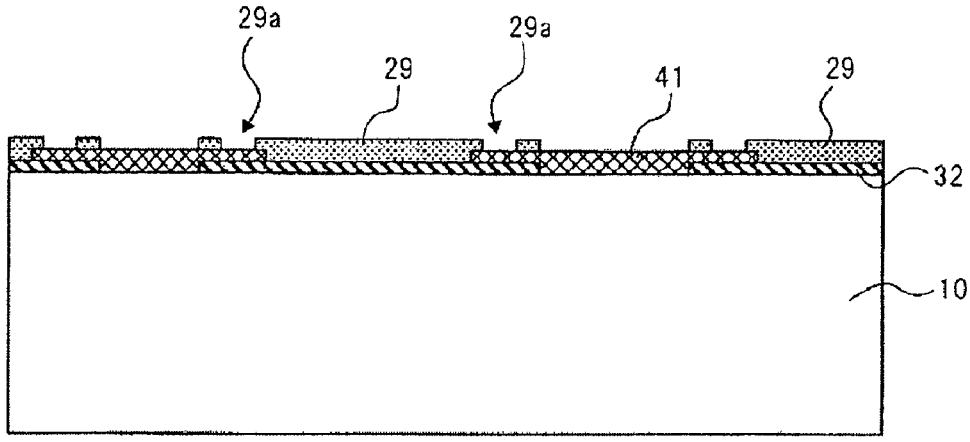
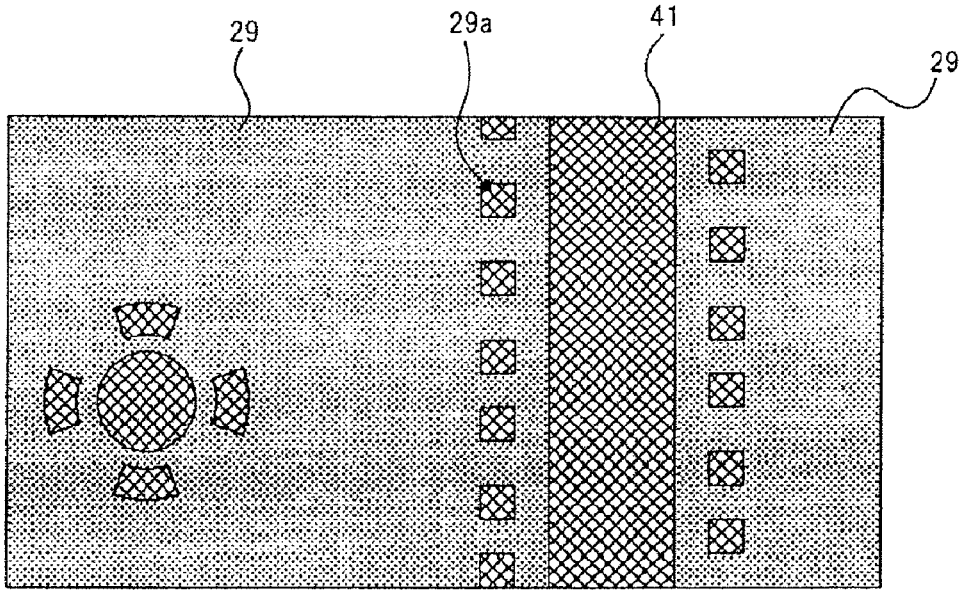
Fig. 7(b)

INK JET RECORDING HEAD, MANUFACTURING METHOD THEREOF, AND ELECTRON DEVICE

FIELD OF THE INVENTION AND RELATED ART

The present invention relates to an ink jet recording head for ejecting ink onto a recording material such as recording paper or the like and an electron device in which a substrate is provided with a through-opening.

In recent years, in the field of a semiconductor device, in order to meet a demand for further downsizing of portable electronic equipment, a technique for increasing a packing density of the device by mounting the device three-dimensionally has been proposed. In this technique, the semiconductor device which has been arranged two-dimensionally is vertically disposed in a superposition manner and giving and receiving of a signal between devices are performed through an electrode (feedthrough electrode) penetrating through a substrate on which a semiconductor element is formed. By this technique, compared with a conventional technique in which the giving and receiving of the signal between the semiconductor devices arranged two-dimensionally are performed through wiring formed on a printed board, the device packing density can be increased, so that the downsizing of a resultant apparatus can be realized.

In the field of the ink jet recording head, structures provided with a supply port penetrating through a substrate have been proposed for various purposes. Japanese Laid-Open Patent Application Hei 9-11478 discloses a constitution for forming a protection layer at a wall surface of a substrate defining a supply port so that a substrate material (e.g., silicon) does not dissolve in ink.

Further, also with respect to the recording head, giving and receiving of a signal between the recording head and a main assembly of a recording apparatus located on a back surface side of the recording head (a side opposite from a side on which nozzles are formed) can be performed through a feedthrough electrode. In such a case, wiring for the giving and receiving of the signal is not present between the recording head and a recording material, so that a distance from the recording head to the recording material is shortened correspondingly. As a result, placement precision of the ink is improved, so that it is possible to output an image with a higher image quality.

In the case of forming the feedthrough electrode in the electron device, it is necessary to form an insulation layer for insulating an electroconductive layer from a substrate. Then, in a step after the insulation layer is formed, e.g., even when an external force is exerted on the insulation layer during bonding of the insulation layer to an external electrode or the like, the insulation layer is required not to cause separation or the like. Such a separation of the insulation layer is particularly apprehended in the case where an organic material is selected as a material for forming the insulation layer.

On the other hand, also with respect to the ink jet recording head, it is assumed that there arises a similar problem when the through-opening of the electron device is replaced with the supply port and the insulation layer of the electron device is represented with the protection layer. Further, with respect to the protection layer for the supply port, the ink can gradually permeate an interface between the protection layer and a function layer which are exposed at a wall surface of the substrate defining the supply port. In such a case where the permeated ink reaches the substrate and is easily circulated along a permeation path, an amount of dissolution of the substrate material in the ink is increased, so that such an ink causes an inconvenience such as clogging or the like of an ejection outlet.

SUMMARY OF THE INVENTION

A principal object of the present invention is to provide an electron device capable of suppressing separation of an insulation layer formed at a wall surface of a substrate defining a through-opening and to provide a manufacturing method of the electron device.

Another object of the present invention is to provide an ink jet recording head capable of suppressing separation of a protection layer formed at a wall surface of a substrate defining a supply port and capable of preventing ink from easily permeating into the substrate and to provide a manufacturing method of the ink jet recording head.

According to an aspect of the present invention, there is provided an ink jet recording head comprising:

a substrate, having a front surface and a back surface opposite from the front surface, provided above the front surface with an energy generating element for generating energy used for ejecting ink;

an ink supply port provided so as to penetrate between the front surface and the back surface of the substrate;

a first layer provided on or above the front surface of the substrate;

a protection layer which is provided so as to coat a wall of the substrate defining the ink supply port and which continuously extends onto the first layer; and a second layer located above the front surface of the substrate and including a portion provided on the protection layer and another portion provided on the first layer by penetrating through the protection layer.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 4(*a*) and 4(*b*) and FIGS. 5A to 5E are longitudinal sectional views for illustrating a manufacturing method of the ink jet recording head.

FIGS. 7(*a*) and 7(*b*) and FIGS. 8A to 8E are longitudinal sectional views for illustrating a manufacturing method of the ink jet recording head shown in FIGS. 6(*a*) and 6(*b*).

DESCRIPTION OF THE PREFERRED EMBODIMENTS

Hereinbelow, embodiments of an ink jet recording head (liquid ejection head) according to the present invention will be described specifically with reference to the drawings.

The liquid ejection head (the ink jet recording head) is mountable to a printer, a copying machine, a facsimile machine including a communication system, a device such as a word processor including a printer portion, and industrial recording devices compositively combined with various processing devices. Further, by using this liquid ejection head, it is possible to carry out recording on various recording media (materials) such as paper, thread, fiber, fabric, leather, metal, plastic, glass, wood, and ceramics. Herein, "recording" means not only that a significant image such as a character image or a graphical image is provided to the recording medium but also that an insignificant image such as a pattern image is provided to the recording medium.

Further, "ink" or "liquid" should be broadly interpreted and refers to ink or liquid to be subjected to formation of an image, a pattern, or the like; processing of the recording medium; or treatment of the recording medium, by being provided onto the recording medium. The treatment of the recording medium refers to, e.g., improvements in fixing property, recording quality or coloring property, and image durability, by coagulation or insolubilization of a coloring material contained in the ink.

An embodiment of the ink jet recording head according to the present invention and a manufacturing method thereof will be described below.

Figure 1A:
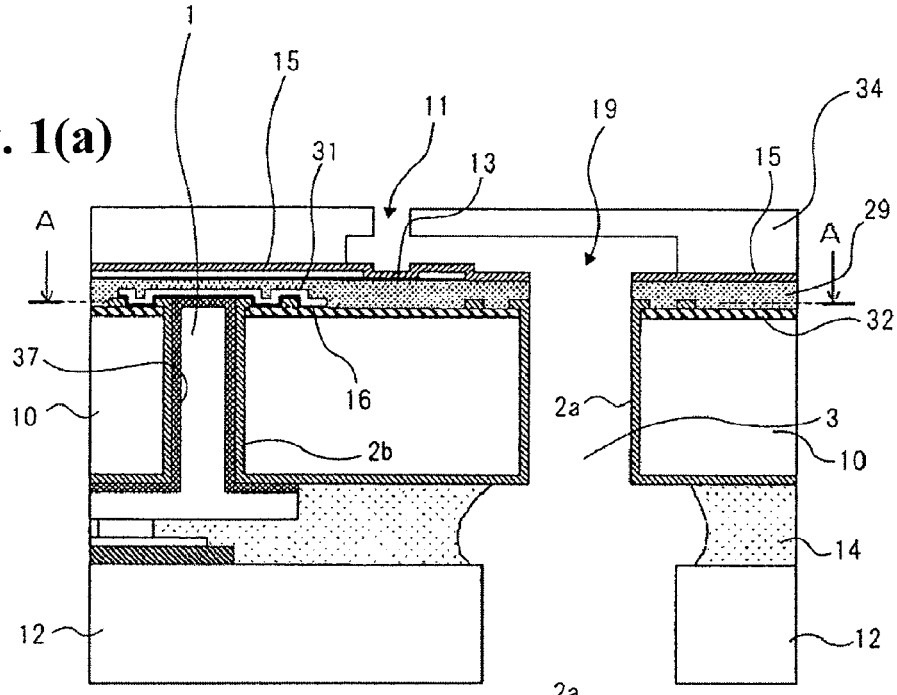
FIGS. 1(*a*) and 1(*b*) are schematic views for illustrating a constitution of an ink jet recording head according to an embodiment of the present invention.
Figure 1B:
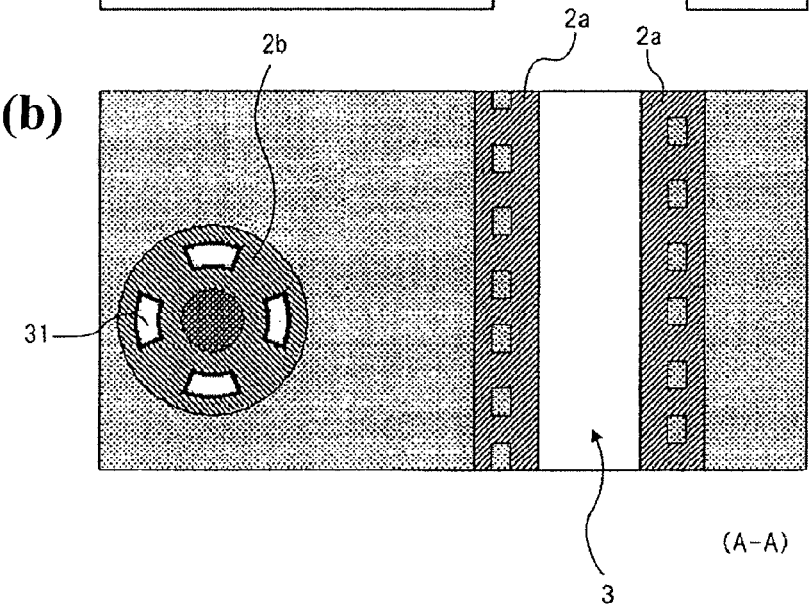

FIG. 1(*a*) is a schematic sectional view showing a structure of the recording head of this embodiment and FIG. 1(*b*) is a schematic sectional view taken along A-A line indicated in FIG. 1(*a*).

As shown in FIGS. 1(*a*) and 1(*b*), the recording head of this embodiment includes a nozzle member having an ejection outlet 11 for ejecting ink and an ink flow passage 19 communicating with the ejection outlet 11. The recording head further includes a silicon substrate 10 provided with an ejection energy generating element 13 for generating energy (pressure) for ejecting the ink from the ejection outlet 11 and a driving circuit consisting of a plurality of laminated function layers for driving the ejection energy generating element 13. The silicon substrate 10 is also provided with a supply port 3 for supplying the ink to the ink flow passage 19 by penetration through the silicon substrate 10 and the plurality of function layers.

The silicon substrate is further provided with a feedthrough electrode 1, electrically connected to an electroconductive function layer contained in the plurality of function layers, by penetration through the silicon substrate 10. The recording head further includes a protection layer 2*a* formed to coat a wall surface of the silicon substrate 10 defining the supply port 3 and an insulation layer 2*b* formed at another wall surface of the silicon substrate 10 defining the feedthrough electrode 1. Even in the case of an electron device having only the feedthrough electrode 1 provided with the insulation layer 2*b* and even in the case of a recording head having only the supply port 3 provided with the protection layer 2*b*, when associated portions are extracted from the electron device and the recording head, the same structure is obtained.

Between the plurality of function layers or between the silicon substrate 10 and the function layers, a part of the protection layer 2*a* is interposed and is provided with a plurality of holes. Inside these holes, the plurality of function layers interposing the protection layer 2*a* contact with each other or the silicon substrate 10 and the function layers interposing the protection layer 2*a* contact with each other. As shown in FIG. 1(*b*), the protection layer 2*a* is provided with the plurality of holes disposed with predetermined intervals along a longitudinal direction of the supply port 3 having an elongated shape.

Further, the recording head includes a chip plate 12 for supporting the back surface of the silicon substrate 10 and a sealant 14 for sealing a spacing between the silicon substrate 10 and the chip plate 12.

The protection layer and the insulation layer may preferably be formed of an organic material such as polyparaxylylene, polyimide, polyurea, or the like at a low temperature by a vapor-phase growth method such as chemical vapor deposition (CVD) or a vapor deposition polymerization. These materials are capable of easily coating projections and recesses present at the wall surfaces defining the supply port and the through-opening and are also liable to enter a spacing created after removing a sacrifice layer, thus being suitable for the protection layer and the insulation layer.

In the ink jet recording head or the electron device in which a transistor is incorporated, as the substrate, a semiconductor of silicon or the like can be considered. Further, as the function layers, it is possible to select insulating films of silicon oxide, silicon nitride, and the like, and wiring layers of aluminum, copper, and the like. Particularly, as the function layers in the ink jet recording head, it is possible to use a heater layer provided with the ejection energy generating element 13 to TaSiN or the like, anti-cavitation layer of tantalum, silicon carbide, or the like for protecting underlying layers from pressure during bubble generation and bubble collapse.

As a material for the sacrifice layer, any material may be used so long as the sacrifice layer can be removed at a rate faster than those of the function layers contacting the sacrifice layer or the substrate. For example, in the case where the function layer contacting the sacrifice layer is formed of aluminum, copper, tantalum, silicon carbide, or the like, as the sacrifice layer, e.g., a layer of silicon oxide, PSG, BPSG, or the like is used. As a result, the sacrifice layer can be removed by vapor of hydrogen fluoride or a mixture aqueous solution of hydrogen fluoride and ammonium fluoride.

Figure 2:
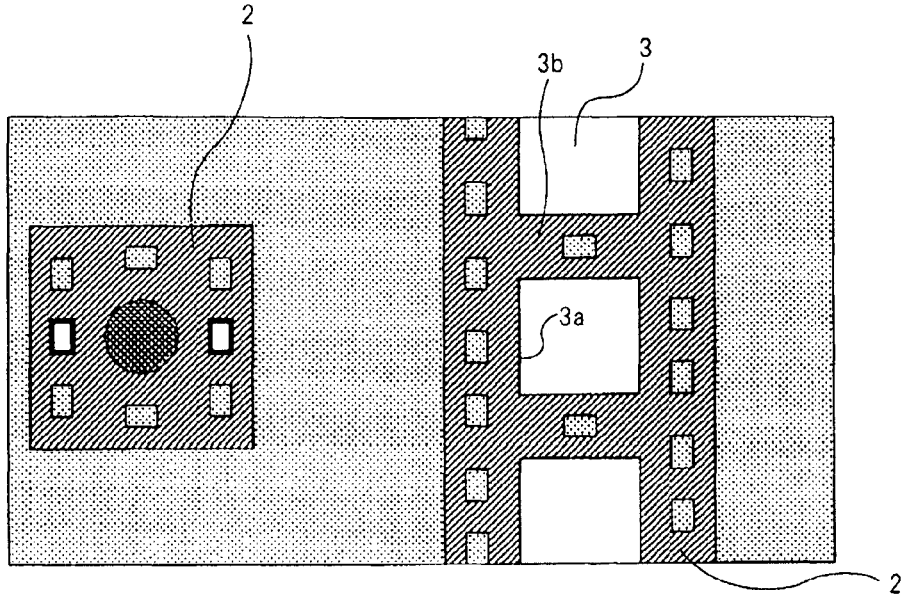
FIGS. 2 and 3 are cross-sectional views each for illustrating another constitution of the ink jet recording head.

FIG. 2 shows another constitution of the recording head shown in FIG. 1(*a*). As shown in FIG. 2, a plurality of supply ports 3*a* is constituted by providing a plurality of beams 3*b* to the elongated supply port 3 with respect to a lateral (widthwise) direction of the elongated supply port 3. That is, the beams 3*b* are formed so as to extend in parallel to a direction perpendicular to an arrangement direction of a plurality of ejection outlets 11. A portion of the beams 3*b* disposed between respective adjacent supply ports 3*a* is also coated with the protection layer 2*a*. The protection layer 2*a* provided to the beams 3*b* is provided with holes.

Figure 3:
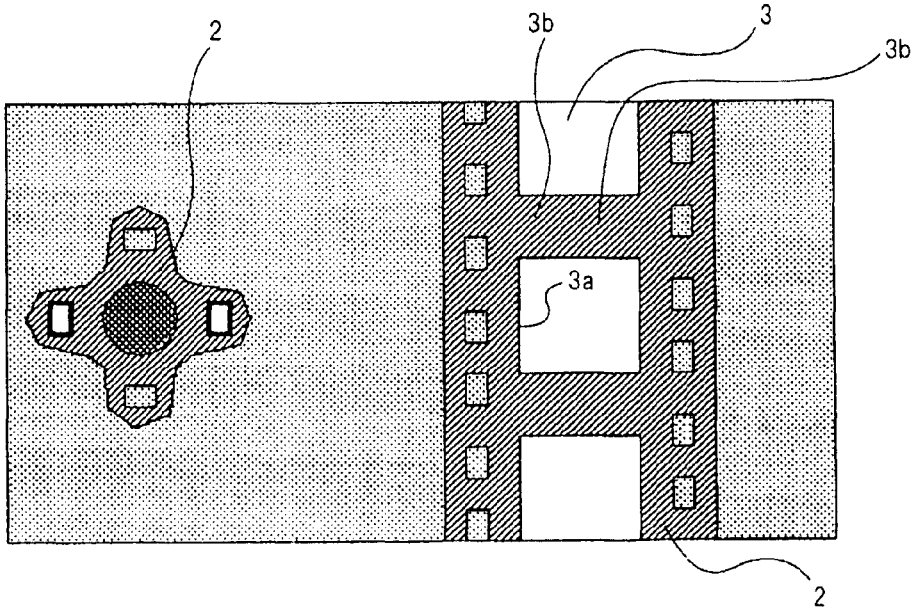

FIG. 3 shows a further constitution of the recording head shown in FIG. 1(*a*). As shown in FIG. 3, on the beams 3*b* of the supply port 3, the holes of the protection layer 2*a* are not disposed, so that an ink permeation path is not provided at all. This constitution is effective in the case where it is necessary to provide a structure for preventing the ink permeation for a longer period at the portion of the beams 3*b* formed in relatively narrow shape on the supply port 3 of the silicon substrate 10.

First Embodiment

A manufacturing method of the recording head shown in FIGS. 1(*a*) and 1(*b*) will be described more specifically.

First, on a front surface of a single crystal silicon substrate 10, a silicon oxide layer 32 functioning as an element isolation layer for a MOS (metal oxide semiconductor) is formed by a thermal oxidation method. The silicon oxide layer 32 is also referred to as a first layer. On the silicon oxide layer 32, a sacrifice layer 30 is formed by using a general-purpose photolithographic technique and an etching technique, so that the sacrifice layer 30 is formed in a pattern shape having a plurality of holes 30*a* as shown in FIGS. 4(*a*) and 4(*b*) when the front surface of the silicon substrate 10 is viewed two-dimensionally. The pattern includes at least a part of the sacrifice layer 30 which is located inside an area in which the supply port 3 is formed in a later step and which extends to an outside of the area while being provided with the holes 30*a*.

Figure 5A:
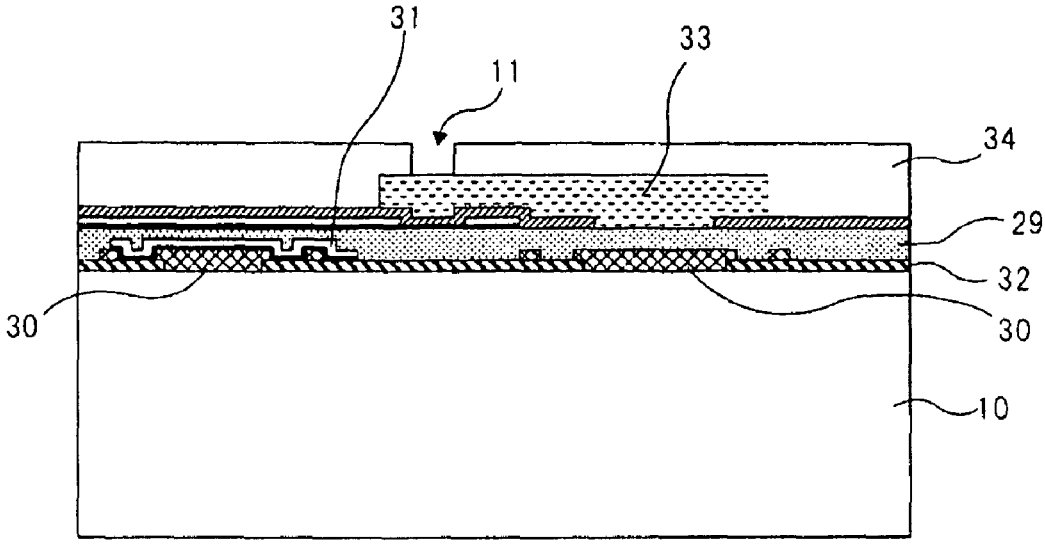

Then, as shown in FIG. 5A, on the sacrifice layer 30, a wiring layer 31 constituting the drive circuit as an electronic circuit is formed by the general-purpose semiconductor manufacturing technique. Further, a silicon oxide layer 29 which is a function layer as an interlayer insulation layer is formed by a plasma CVD method. The silicon oxide layer 29 is also referred to as a second layer in order to discriminate it from the silicon oxide layer 32. The silicon oxide layer 29 constituting the interlayer insulation layer and the silicon oxide layer 32 formed by the thermal oxidation contact each other inside each of the holes 30*a* of the sacrifice layer 30. Further, the wiring layer 31 and the silicon oxide layer 32 contact each other inside each of the holes 30*a* of the sacrifice layer 30. Thereafter, the function layers such as the anti-cavitation layer are formed.

Next, as an adhesive layer, a layer of polyamide resin material (not shown) is applied and is baked, followed by application of a novolac photoresist. Thereafter, the resist is subjected to patterning by a photolithographic technique and then is subjected to chemical dry etching using $CF_4$ and $O_2$. By this etching, the polyamide resin material is removed from at least an area which is located on the ejection energy generating element 13 and on a pad (not shown) for connecting an external electrode and in which the ejection outlet 3 is to be formed in a later step. Then, the resist is removed by a removing liquid of a monoamine type.

Next, on the front surface of the silicon substrate 10, polymethyl isopropenyl ketone is spin-coated and is pre-baked at 120° C. for 20 minutes. Thereafter, the front surface of the silicon substrate 10 is exposed to ultraviolet (UV) light and then is subjected to development with a mixture solvent (methyl isobutyl ketone/xylene=2/1), followed by rinsing with xylene. Through the above-described steps, as shown in FIG. 5A, a soluble resin material layer 33 is formed on the front surface of the silicon substrate 10. This resin material layer 33 is used for ensuring a space for constituting the ink flow passage 19, between the supply port 3 and the ejection energy generating element 13, shown in FIG. 1.

Then, onto the resin material layer 33, a coating resin material layer 34 of a cation polymerization-type epoxy resin material is applied. Further, onto the coating resin material layer 34, a photosensitive water repellent is applied repeatedly and then an ejection outlet 11 is formed by the photolithographic technique.

Thereafter, to the coating resin material layer 34, a supporting substrate (not shown) for protecting the coating resin material layer 34 is applied by wax. Then, the silicon substrate 10 is subjected to background processing from the back surface side to be abraded, thus being decreased in thickness. Then, a breaking layer is removed by dilute hydrofluoric acid to separate a tape.

Figure 5B:
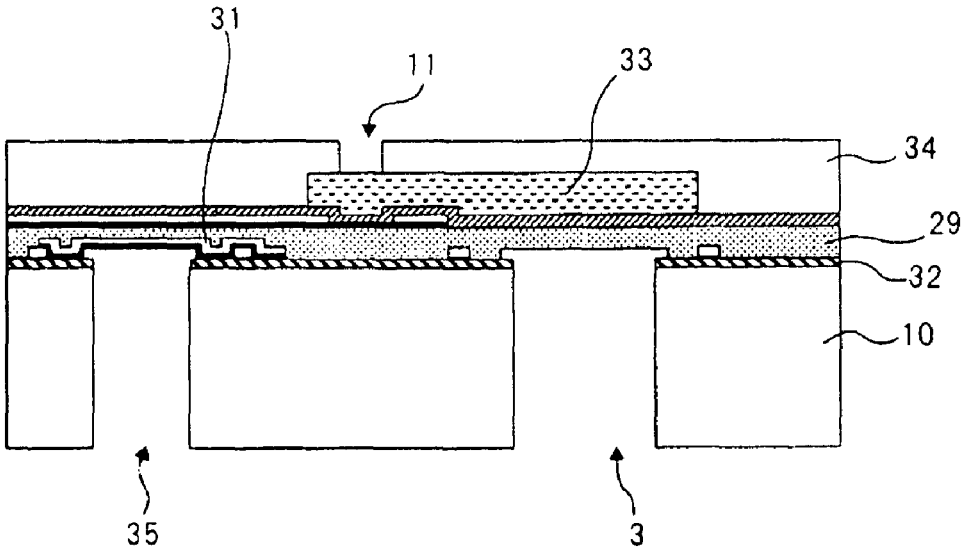

Next, onto the back surface of the silicon substrate 10, a novolac resist is applied and the back surface of the silicon substrate 10 is subjected to patterning, so as to remove positions in which the through-opening 35 for forming the feedthrough electrode 1 and the supply port 3 shown in FIG. 1(*a*) are formed, in a photolithographic step. Then, the back surface of the silicon substrate 10 is subjected to etching from the back surface to the sacrifice layer 30 by an etcher for ICP (inductively-coupled plasma)-RIE (reactive ion etching), thus forming the through-opening 35 and the supply port 3, respectively, as shown in FIG. 5B.

Thereafter, the sacrifice layer 30 exposed so as to face the insides of the through-opening 35 and the supply port 3 is removed. In this case, the sacrifice layer 30 may be formed of any material so long as the material can be etched at a higher rate than those of other peripheral structures and can be formed in a smaller thickness than that of a protection layer 2 to be formed in a later step (FIG. 5B).

In this embodiment, as the sacrifice layer 30, a thin film of aluminum is used and then is removed by isotropic etching using a mixture liquid of phosphoric acid, acetic acid and nitric acid. In this case, the feedthrough electrode 1 can be formed by preliminarily forming a film of barrier metal (upper function layer) as a barrier layer 16 at a lower surface of the wiring layer which is disposed above the sacrifice layer 30 and constitutes the electronic circuit to remove only the sacrifice layer 30 with no erosion of the wiring layer 31. The barrier metal can be appropriately selected from, e.g., titanium, titanium nitride, titanium-tungsten, tantalum nitride, and the like. In this case, the silicon oxide layer 32 functions as a lower function layer.

Next, a film of polyparaxylylene 2 for forming the protection layer 2*a* and the insulation layer 2*b* shown in FIGS. 1(*a*) and 1(*b*) is formed by the CVD method. As a result, the protection layer 2*a* is continuously extended from the wall surface of the silicon substrate 10 defining the supply port 3 to the lower surface of the function layer, the inside of the hole, and the upper surface of the function layer and is then returned to the wall surface of the silicon substrate 10, thus being formed in a continuously extended shape. Similarly, the insulation layer 2*b* is continuously extended from the wall surface of the silicon substrate 10 defining the through-opening 35 to the lower surface of the function layer, the inside of the hole, and the upper surface of the function layer and is then returned to the wall surface of the silicon substrate 10, thus being formed in a continuously extended shape.

Figure 5C:
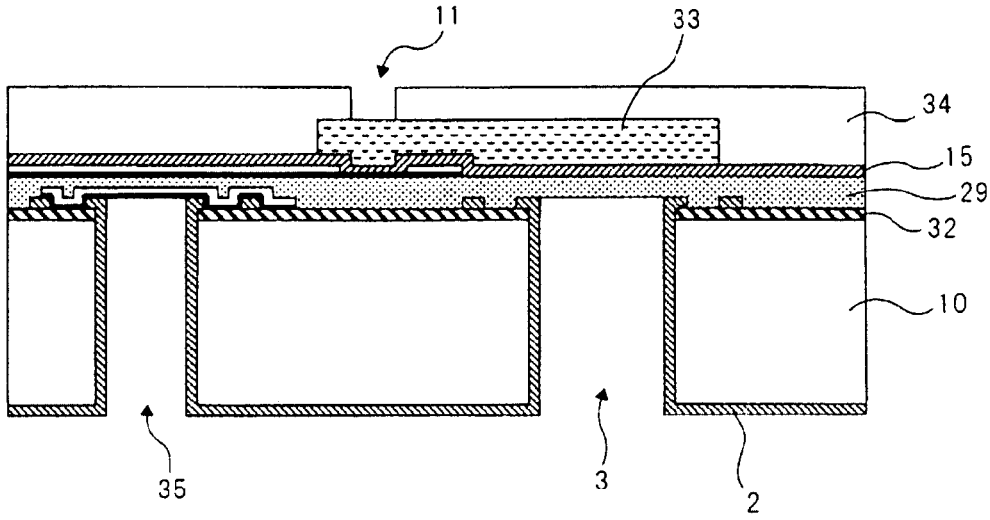

Thereafter, on the back surface of the silicon substrate 10, a resist of a dry film is formed and then is subjected to light exposure and development, followed by removal thereof at the supply port 3 portion. Then, the back surface of the silicon substrate 10 is subjected to RIE which is anisotropic etching as processing with anisotropy, so that the layer 2 of polyparaxylylene is removed at the bottoms of the through-opening 35 and the supply port 3 (FIG. 5C).

Then, the back surface of the silicon substrate 10 is subjected to sputtering with gold for forming an underlying layer for plating. Thereafter, a photosensitive dry film is applied to the back surface of the silicon substrate 10 and is subjected to patterning by the photolithographic technique so as to mask an area in which an electroconductive layer of the feedthrough electrode 1 is not formed. Then, a potential is applied to the underlying layer, so that a gold-plated layer 36 constituting a feedthrough electroconductive layer for the feedthrough electrode 1 and a back surface electroconductive layer is formed. Further, the photosensitive dry film is separated and the underlying layer located in the area in which the gold-plated layer 37 is not present is removed by a mixture liquid of iodine and potassium iodide.

Figure 5D:
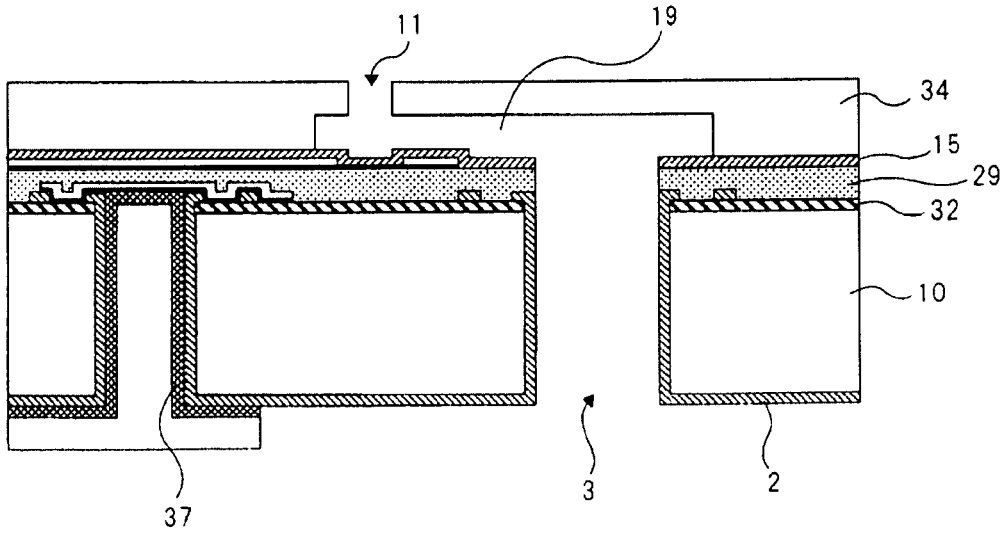

Thereafter, the photosensitive dry film is again applied onto the back surface of the silicon substrate 10 and is subjected to patterning by the lithographic technique in a pattern so as to mask an area other than the supply port 3. Then, as shown in FIG. 5C, by the RIE, a passivation layer (silicon nitride layer) 15 located at the bottom of the supply port 3 is removed and thereafter the entire silicon substrate 10 is immersed in methyl lactate to remove the soluble resin material layer 33 as shown in FIG. 5D.

Figure 5E:
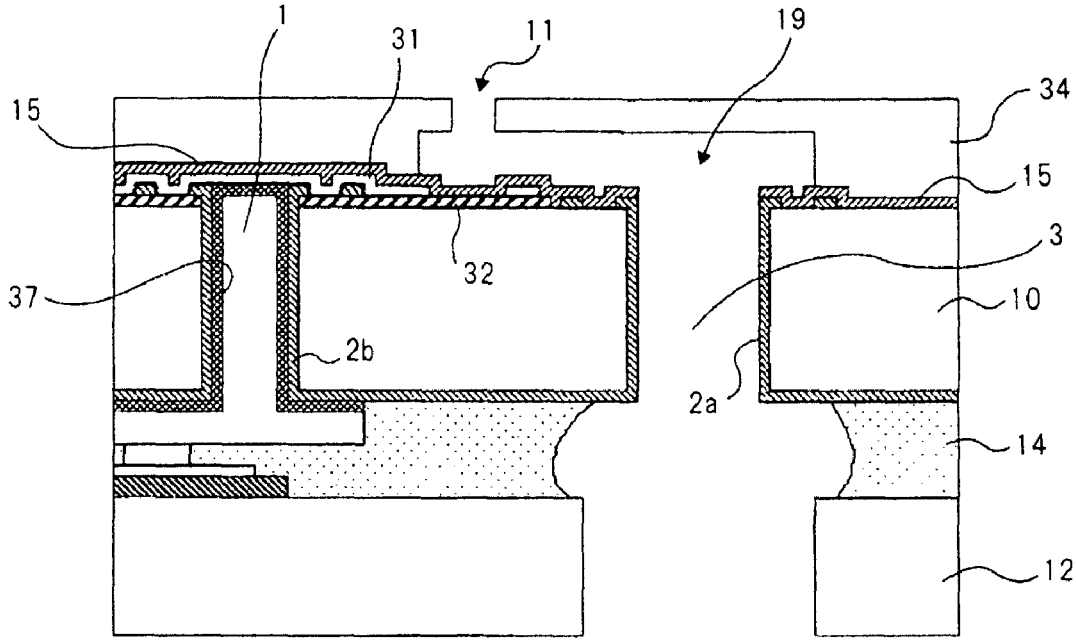

Then, the silicon substrate 10 is heated to a temperature at which the wax is melted and the supporting substrate for protecting the coating resin material layer 34 is separated. Thereafter, the silicon substrate 10 is cut into chips by a dicing device. The resultant chips are applied to a chip plate 12 and are subjected to a step for electrically connecting the external electrode (not shown) and the feedthrough electrode 1, thus being assembled into a form of a cartridge (FIG. 5E). As a result, an ink jet recording head shown in FIG. 1(*a*) is completed.

Second Embodiment

A recording head in this embodiment is manufactured by the following manufacturing method.

First, on a silicon substrate 10, a silicon nitride layer is formed by the thermal CVD method and is subjected to patterning so as to leave only an area in which a wiring layer is formed.

Next, a silicon oxide layer as a sacrifice layer 30 is formed by the plasma CVD method. As the sacrifice layer 30, it is also possible to use films of PSG (phosphor-silicate glass), BSG (boron-doped silicate glass), BPSG (boron-doped phosphor-silicate glass), and the like. These films may also be formed by the CVD method or a spin-on method. Even in the case of using either of the above methods, subsequent steps are identical.

Then, the sacrifice layer 30 is provided with a plurality of holes by using the photolithographic technique and the etching technique.

By the general-purpose semiconductor manufacturing technique, a wiring layer 31 constituting an electronic circuit is formed on the silicon substrate 10 and thereon, a silicon nitride layer 15 functioning as a passivation layer is formed by the plasma CVD method. In this case, the silicon nitride layer 32 formed by the thermal CVD method and the wiring layer 31 contact each other inside each of the holes 30*a* of the sacrifice layer 30. Further, the silicon substrate 10 and the silicon nitride layer 15 as the passivation layer contact each other inside each of the holes 30*a* of the sacrifice layer 30.

The passivation layer may also be formed of silicon carbide. Under the wiring layer 31, as a heat generating resistance layer, a layer of tantalum nitride or TaSiN may also be provided.

On the front surface of the silicon substrate 10, a nozzle member including an ink flow passage 19 and an ejection outlet 11 is formed and from the back surface side of the silicon substrate 10, a through-opening 35 and a supply port 3 are formed by the ICP-RIE etcher. In this step, the same process as in First Embodiment is employed, thus being omitted from explanation.

The sacrifice layer 30 exposed at the bottoms of the through-opening 35 and the supply port 3 is removed by vapor of hydrogen fluoride. The sacrifice layer 30 can also be removed by immersing the entire silicon substrate 10 in so-called buffered hydrogen fluoride and applying ultrasonic wave to the silicon substrate 10 while placing the silicon substrate 10 in a reduced-pressure ambient state.

Next, a layer of polyimide resin material 2 constituting an insulation layer 2*b* and a protection layer 2*a* is formed by a vapor deposition polymerization method. At the same time, the polyimide resin material 2 fills a spacing formed by the removal of the sacrifice layer 30.

Thereafter, on the back surface of the silicon substrate 10, a resist of a dry film is formed and then is subjected to light exposure and development, followed by removal thereof at the supply port 3 portion. Then, the back surface of the silicon substrate 10 is subjected to RIE, so that the polyimide resin material 2 at the bottoms of the through-opening 35 and the supply port 3 is removed.

Then, the back surface of the silicon substrate 10 is subjected to sputtering with gold for forming an underlying layer for plating. Thereafter, a photosensitive dry film is applied to the back surface of the silicon substrate 10 and is subjected to patterning by the photolithographic technique so as to mask an area in which an electroconductive layer is not formed. Then, a potential is applied to the underlying layer, so that a gold-plated layer 36 constituting a feedthrough electroconductive layer and a back surface electroconductive layer is formed. Thereafter, the photosensitive dry film is separated and the underlying layer located in the area in which the gold-plated layer 37 is not present is removed.

Then, by CDE (chemical dry etching), a passivation layer (silicon nitride film) 15 located at the bottom of the supply port 3 is removed and thereafter the silicon substrate 10 is immersed in methyl lactate to remove the soluble resin material layer 33.

Then, the silicon substrate 10 is heated to a temperature at which the wax is melted and the supporting substrate is separated. Thereafter, the silicon substrate 10 is cut into chips by a dicing device. The resultant chips are applied to a chip plate 12 and are subjected to a step for electrically connecting the external electrode and the back surface electroconductive layer, thus being assembled into a form of a cartridge. As a result, an ink jet recording head shown in FIG. 5E is completed.

Third Embodiment

A recording head in this embodiment is manufactured by the following manufacturing method.

Figures 6A, 6B:
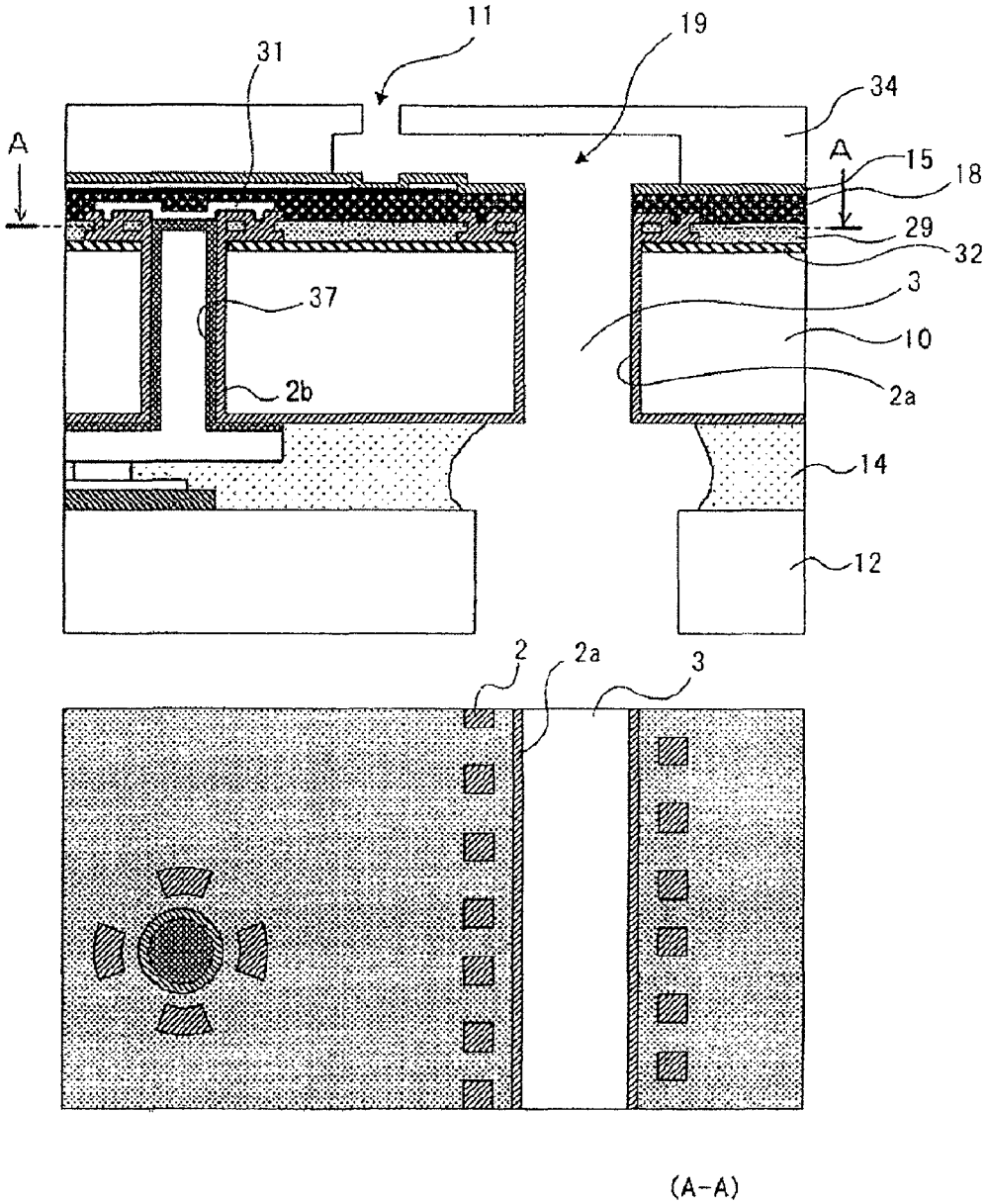
FIGS. 6(*a*) and 6(*b*) are schematic views for illustrating a constitution of an ink jet recording head according to another embodiment of the present invention.

In the recording head in this embodiment, as shown in FIGS. 6(*a*) and 6(*b*), a protection layer 2*a* and an insulation layer 2*b* are formed so as to extend over a function layer 18 and a silicon oxide layer 29 as an intermediary function layer.

First, as shown in FIGS. 7(*a*) and 7(*b*), on the front surface of a single crystal silicon substrate 10, a silicon oxide layer 32 functioning as an element separation layer of MOS is formed by the thermal oxidation method. On the silicon oxide layer 32, an aluminum film constituting a first sacrifice layer 41 is formed and then is subjected to the patterning by the general-purpose photolithographic technique and etching technique, so as to cover an area in which a supply port 3 is formed in a later step.

On the first sacrifice layer 41, a silicon oxide layer 29 formed as an interlayer insulation layer for an electronic circuit is formed by the CVD method so as to also function as an intermediary function layer. The silicon oxide layer 29 functioning as the intermediary function layer is provided with a plurality of holes 29*a* at a portion located on the first sacrifice layer 41 and is removed at a portion in an area in which the supply port 3 is to be formed.

Figure 8A:
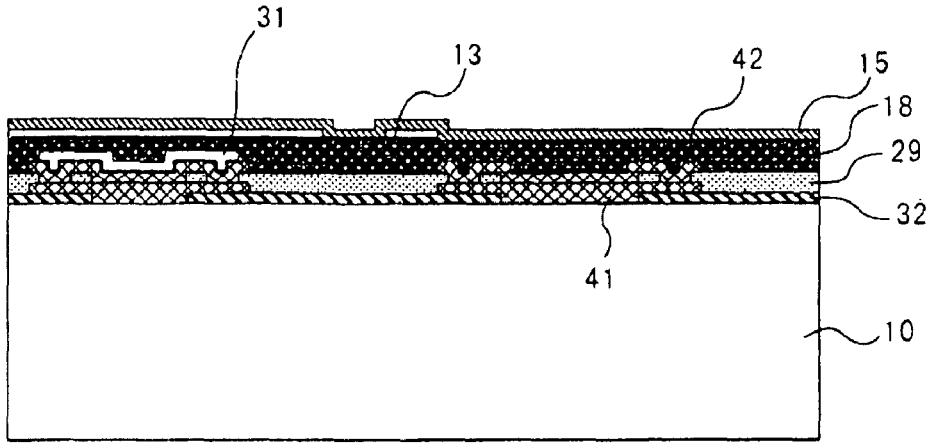

Further, on the silicon oxide layer 29 constituting the intermediary function layer, an aluminum film constituting a second sacrifice layer 42 is formed and is then subjected to patterning. In this case, as shown in FIG. 8A, the first sacrifice layer 41 and the second sacrifice layer 42 contact each other inside each of the holes 29*a* and on the area in which the supply port 3 is to be formed.

Thereafter, on the front surface of the silicon substrate 10, a passivation layer 15 and a function layer 18 including an anti-cavitation layer or the like are formed by lamination.

Figure 8B:
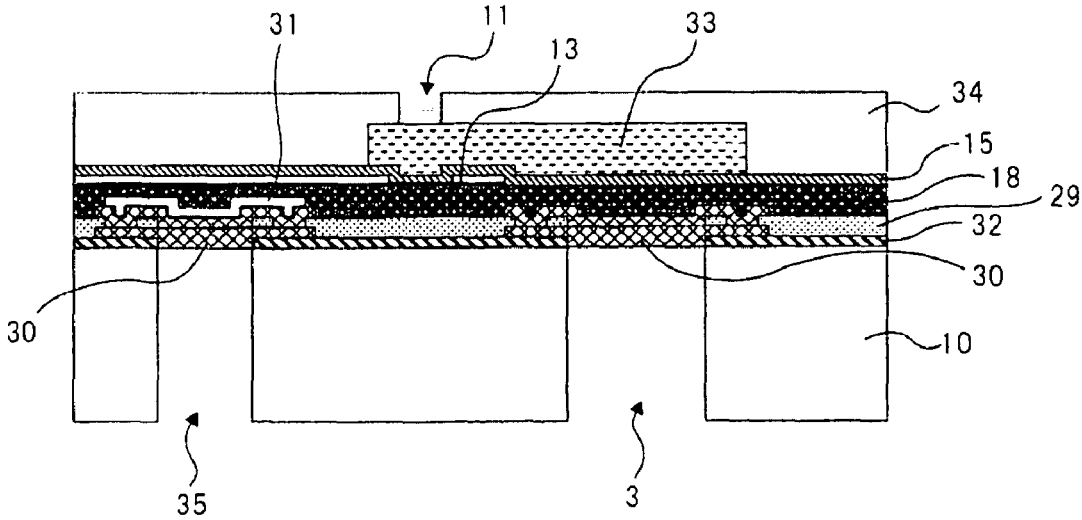

Then, to the silicon substrate 10, a nozzle member including an ink flow passage 19 and an ejection outlet 11 is provided. Then, as shown in FIG. 8B, from the back surface side of the silicon substrate 10, a through-opening 35 and the supply port 3 are formed by the ICP-RIE etcher. This step is identical to that in the above-described Embodiments, thus being omitted from explanation.

Figure 8C:
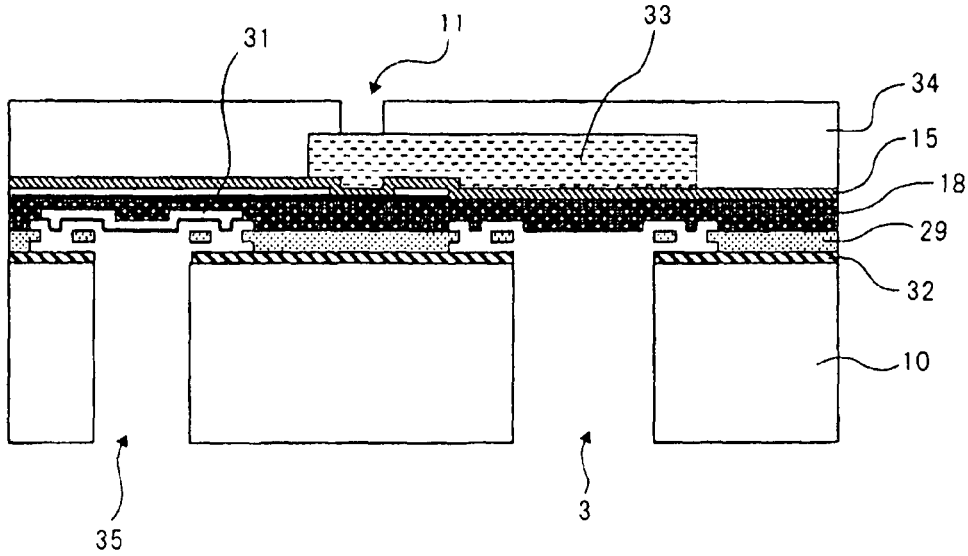

Thereafter, thin films of aluminum as the first and second sacrifice layers 41 and 42 exposed inside the through-opening 35 and the supply port 3 are removed by, e.g., a mixture liquid of phosphoric acid, acetic acid and nitric acid. As a result, as shown in FIG. 8C, spacings communicating the supply port 3 and the through-opening 35 are formed at a portion located on and under a part of the silicon oxide layer 29 as the intermediary function layer and the holes. When the spacings are dried after the removal with the mixture liquid, a supercritical drying method using carbon dioxide may preferably be employed.

Incidentally, the spacings may be formed at a part of a portion between the lower surface of the silicon oxide layer 29 and the silicon substrate 10 or a function layer located under the silicon oxide layer 29, a part of a portion between the upper surface of the silicon oxide layer 29 and an upper function layer, and at least a part of the holes provided to the silicon oxide layer 29. These spacings are formed so as to communicate with the supply port 3.

In the case where the through-opening 35 is provided with a feedthrough electrode, a barrier metal layer as a barrier layer 16 may desirably be formed in advance between the second sacrifice layer 4 and the wiring layer 31 constituting the electronic circuit located on the second sacrifice layer 42. A material for the barrier metal layer may be appropriately selected from, e.g., titanium, titanium nitride, tantalum nitride, and the like.

Next, a layer of polyurea resin material 2 constituting an insulation layer 2*b* and a protection layer 2*a* is formed by a vapor deposition polymerization method. At the same time, the polyurea resin material 2 fills the spacings formed on and under the silicon oxide layer 29 and formed in the holes of the silicon oxide layer 29.

Figure 8D:
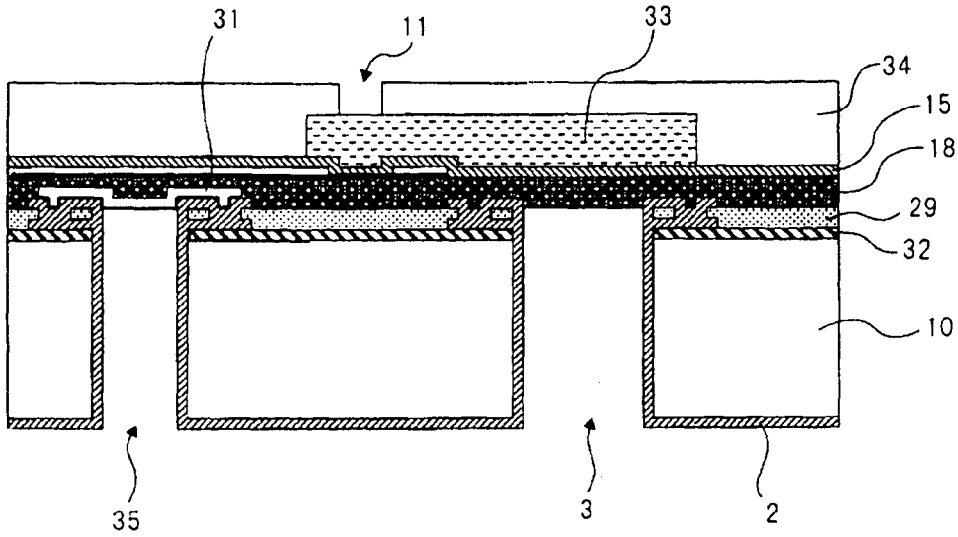

Thereafter, on the back surface of the silicon substrate 10, a resist of a dry film is formed and then is subjected to light exposure and development, followed by removal thereof at the supply port 3 portion. Then, the back surface of the silicon substrate 10 is subjected to RIE, so that the polyurea resin material 2 at the bottoms of the through-opening 35 and the supply port 3 is removed (FIG. 8D).

Then, the back surface of the silicon substrate 10 is subjected to sputtering with gold for forming an underlying layer for plating. Thereafter, a photosensitive dry film is applied to the back surface of the silicon substrate 10 and is subjected to patterning by the photolithographic technique so as to mask an area in which an electroconductive layer is not formed. Then, a potential is applied to the underlying layer, so that a gold-plated layer 36 constituting a feedthrough electroconductive layer and a back surface electroconductive layer is formed. Thereafter, the photosensitive dry film is separated and the underlying layer located in the area in which the gold-plated layer 37 is not present is removed.

Figure 8E:
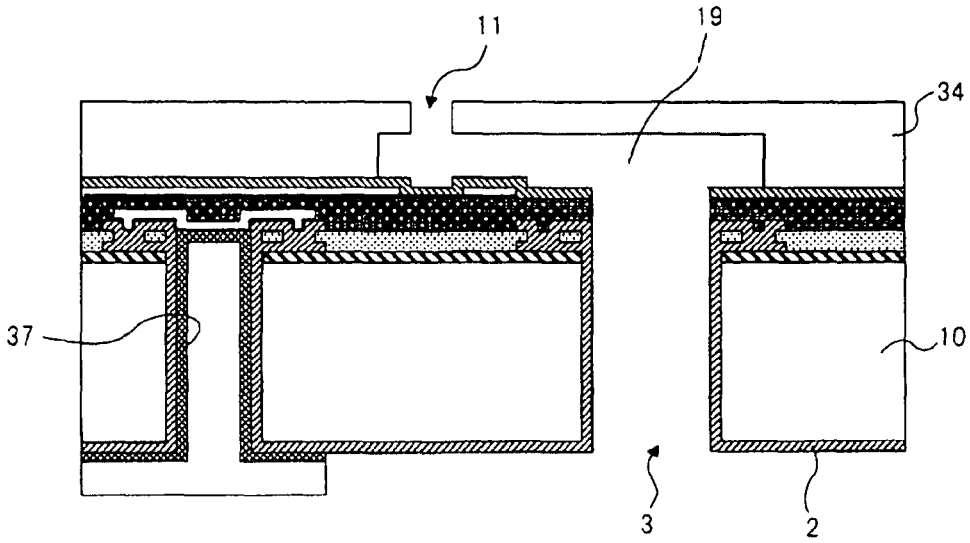

Then, by the CDE, a passivation layer (silicon nitride film) 15 formed at the bottom of the supply port 3 is removed and thereafter the silicon substrate 10 is immersed in methyl lactate to remove the soluble resin material layer 33 (FIG. 8E).

Then, the silicon substrate 10 is heated to a temperature at which the wax is melted and the supporting substrate is separated. Thereafter, the silicon substrate 10 is cut into chips by a dicing device. The resultant chips are applied to a chip plate 12 and are subjected to a step for electrically connecting the external electrode and the back surface electroconductive layer, thus being assembled into a form of a cartridge. As a result, an ink jet recording head shown in FIGS. 6(*a*) and 6(*b*) is completed.

Fourth Embodiment

Figure 9:
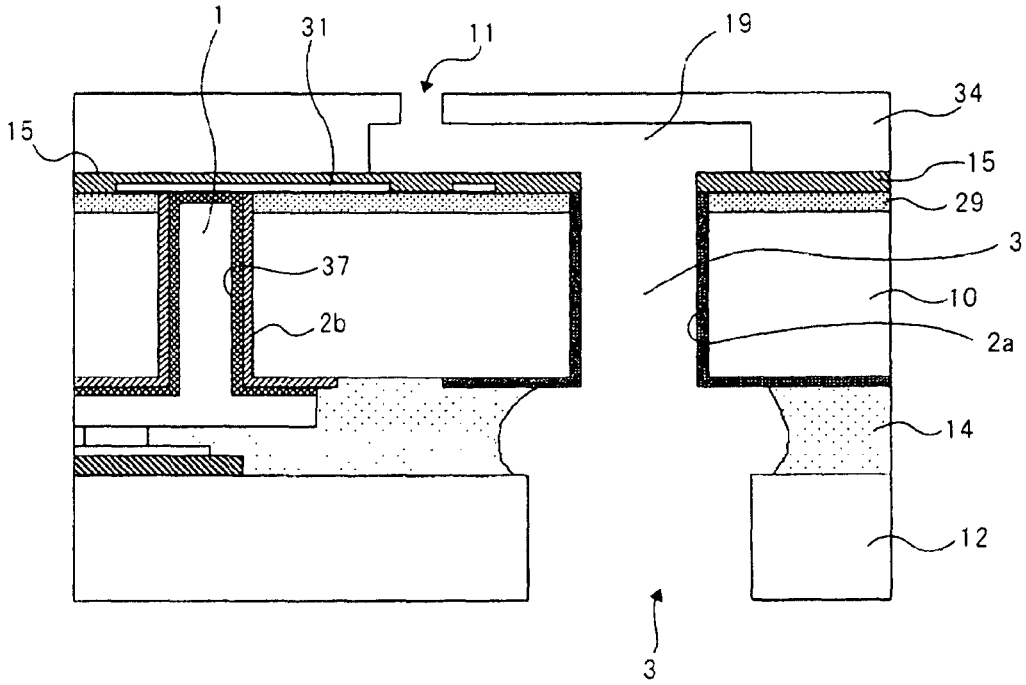
FIG. 9 is a longitudinal sectional view for illustrating a manufacturing method of an ink jet recording head according to a further embodiment of the present invention.

A recording head in this embodiment as shown in FIG. 9 is manufactured by the following manufacturing method.

In the manufacturing method in this embodiment, as a sacrifice layer, a silicon oxide layer formed by the plasma CVD method is used. As the silicon oxide layer, it is also possible to use the PSG film, the BSG film, and the BPSG film. These films may also be formed by the CVD method or the spin-on method.

After a supply port 3 and a through-opening 35 are formed, the sacrifice layer is removed by vapor of hydrogen fluoride or buffered hydrogen fluoride. For this reason, of function layers contacting the sacrifice layer, materials for an insulation layer and a passivation layer are selected from silicon nitride and the like and a material for an anti-cavitation layer is selected from silicon carbide, tantalum, and the like. Further, a material for a resistor is selected from substances less affected by hydrogen fluoride such as tantalum nitride, TaSiN, and the like. Other constitutions and steps are identical to those in the manufacturing method in Third Embodiment, thus being omitted from explanation.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 080747/2008 filed Mar. 26, 2008, which is hereby incorporated by reference.

What is claimed is:

1. An ink jet recording head comprising:

a substrate, having a front surface and a back surface opposite from the front surface, provided above the front surface with an energy generating element for generating energy used for ejecting ink;

an ink supply port provided so as to penetrate between the front surface and the back surface of said substrate;

a first layer provided on or above the front surface of said substrate;

a protection layer which is provided so as to coat a wall of said substrate defining said ink supply port and which continuously extends onto said first layer; and a second layer located above the front surface of said substrate and including a portion provided on said protection layer and another portion provided on said first layer by penetrating through said protection layer.

2. A head according to claim 1, wherein said protection layer is formed of a material selected from the group consisting of polyparaxylylene, polyimide, and polyurea.

3. A head according to claim 1, wherein said first layer is formed of silicon oxide and said second layer is formed of silicon oxide.

4. A head according to claim 2, wherein said first layer is formed of silicon oxide and said second layer is formed of silicon oxide.

* * * * *